US011248342B2

(12) United States Patent
Moriwaki

(10) Patent No.: US 11,248,342 B2
(45) Date of Patent: Feb. 15, 2022

(54) PAPER TUBE AND ROLLED SHEET USING THE PAPER TUBE

(71) Applicant: DAIO PAPER CORPORATION, Ehime (JP)

(72) Inventor: Teppei Moriwaki, Shizuoka (JP)

(73) Assignee: DAIO PAPER CORPORATION, Ehime (JP)

( * ) Notice: Subject to any disclaimer, the term of this patent is extended or adjusted under 35 U.S.C. 154(b) by 21 days.

(21) Appl. No.: 15/759,273

(22) PCT Filed: Aug. 31, 2016

(86) PCT No.: PCT/JP2016/075487
§ 371 (c)(1),
(2) Date: Mar. 12, 2018

(87) PCT Pub. No.: WO2017/047385
PCT Pub. Date: Mar. 23, 2017

(65) Prior Publication Data

US 2018/0179706 A1 Jun. 28, 2018

(30) Foreign Application Priority Data

Sep. 14, 2015 (JP) ..... JP2015-180376

(51) Int. Cl.
*D21H 23/22* (2006.01)
*A47K 10/16* (2006.01)
*B65H 75/10* (2006.01)

(52) U.S. Cl.
CPC ..... *D21H 5/0005* (2013.01); *A47K 10/16* (2013.01); *B65H 75/10* (2013.01); *B05D 2254/02* (2013.01); *B05D 2254/04* (2013.01)

(58) Field of Classification Search
CPC ..... D21H 5/0005; A47K 10/16; B65H 75/10; B05D 2254/02; B05D 2254/04
See application file for complete search history.

(56) References Cited

U.S. PATENT DOCUMENTS 9,756,991 B2 * 9/2017 Mellin ..... A47K 10/16
2012/0294829 A1 11/2012 Lee et al.

FOREIGN PATENT DOCUMENTS

| | | |
|---|---|---|
| CN | 104414559 | 3/2015 |
| CN | 104416955 | 3/2015 |
| JP | H11-332778 | 12/1999 |
| JP | 2000-327512 | 11/2000 |
| JP | 2003-325372 | 11/2003 |
| JP | 2004-043071 | 2/2004 |
| JP | 2007-303028 | 11/2007 |

(Continued)

OTHER PUBLICATIONS

Takanori Translation (Year: 2007).*

(Continued)

*Primary Examiner* — Sean E Conley
*Assistant Examiner* — Brendan A Hensel
(74) *Attorney, Agent, or Firm* — IPUSA, PLLC

(57) ABSTRACT

A paper tube that functions as a core of a rolled sheet, the paper tube includes an inside base paper layer at an inside peripheral surface of the paper tube; and an outside base paper layer at an outside peripheral surface of the paper tube, polyphenol and glycerin being impregnated in at least one of the inside base paper layer and the outside base paper layer.

9 Claims, 2 Drawing Sheets

(56) References Cited

FOREIGN PATENT DOCUMENTS

| | | | | |
|---|---|---|---|---|
| JP | 2007303028 | * | 11/2007 | ..... D21H 19/10 |
| JP | 2008-088587 | | 4/2008 | |
| JP | 2009-150032 | | 7/2009 | |
| JP | 2009-242019 | | 10/2009 | |
| JP | 2014-104066 | | 6/2014 | |
| JP | 2014-193212 | | 10/2014 | |
| JP | 2014-198187 | | 10/2014 | |
| JP | 2014198187 | * | 10/2014 | ..... A47K 10/16 |
| JP | 2014-224151 | | 12/2014 | |
| JP | 2015-047302 | | 3/2015 | |

OTHER PUBLICATIONS

Asami Translation (Year: 2014).*
Klein, Shampoo Formulation, 2007, Cosmetech Laboratories, vol. 1, pp. 292-293 (Year: 2007).*
Rhim, Effect of Moisture Content on Tensile Properties of Paper-based Food Packaging Materials (Year: 2010).*
International Search Report for PCT/JP2016/075487 dated Oct. 11, 2016.
Extended European search report for European Patent Application No. 16846256.2 dated Sep. 11, 2018.
Chinese First Office Action for No. 201680052072.8 dated Feb. 27, 2020.

* cited by examiner

PAPER TUBE AND ROLLED SHEET USING THE PAPER TUBE

BACKGROUND OF THE INVENTION

1. Field of the Invention

The present invention relates to a paper tube and a rolled sheet using the paper tube.

2. Description of the Related Art

Conventionally, in order to moderate or remove smells generated in a toilet room, a toilet roll, which is regularly provided in the toilet room, is known in which a polyphenol series deodorant is impregnated in a paper tube thereof (see Patent Document 1, for example).

[Patent Document]

Patent Document 1: Japanese Laid-open Patent Publication No. 2014-104066

However, there is a problem that such a polyphenol series deodorant is easily oxidized by oxygens in air, and its deodorizing effect is easily lost.

In particular, as polyphenol microscopically dissolves in water vapor in a toilet room where humidity is high, and its oxidation reactivity is increased, there is a problem that a deodorizing effect of polyphenol is furthermore easily lost.

SUMMARY OF THE INVENTION

The purpose of the present invention is to provide a paper tube capable of retaining a deodorizing effect for a long period, and a rolled sheet using the paper tube.

According to an embodiment, there is provided a paper tube that functions as a core of a rolled sheet, the paper tube including: an inside base paper layer at an inside peripheral surface of the paper tube; and an outside base paper layer at an outside peripheral surface of the paper tube, polyphenol and glycerin being impregnated in at least one of the inside base paper layer and the outside base paper layer.

According to the embodiment, a paper tube capable of retaining a deodorizing effect for a long period, and a rolled sheet using the paper tube can be obtained.

DETAILED DESCRIPTION OF THE PREFERRED EMBODIMENTS

Embodiments of the invention are described in detail with reference to drawings in the following. However, the scope of the invention is not limited to the illustrated examples. In the following description, a rolled toilet paper in which a toilet paper as a sheet is wound around a paper tube is exemplified as a rolled sheet using a paper tube of the embodiment.

(Toilet Paper)

Figure 1:
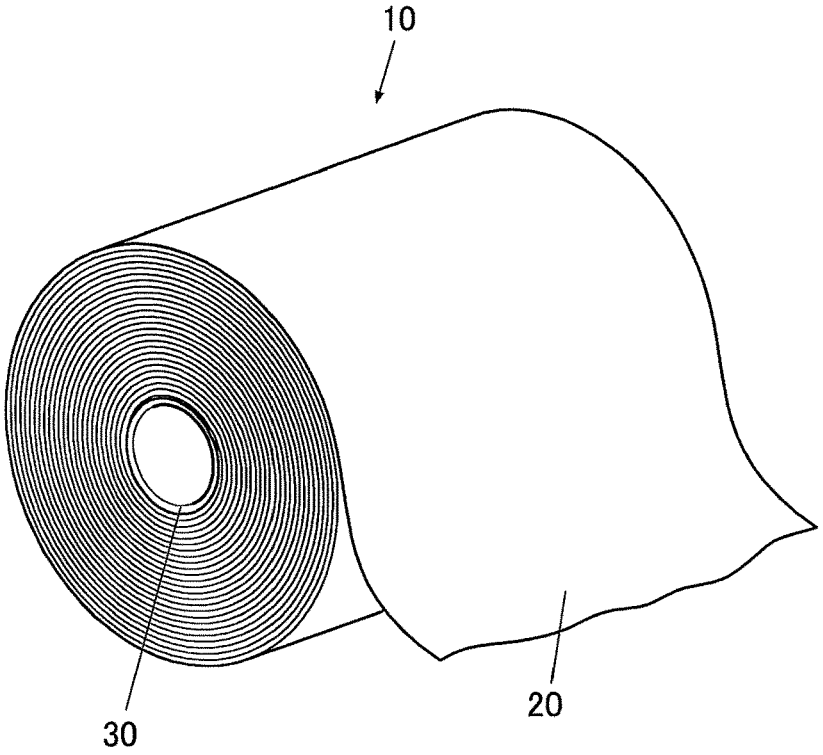
FIG. 1 is a perspective view illustrating a rolled toilet paper of an embodiment.

As illustrated in FIG. 1, for example, a rolled toilet paper 10 includes a paper tube 30 having a substantially hollow cylindrical shape, and a toilet paper 20 formed to have a certain width and wound around the paper tube 30 as a core. It is general to use the rolled toilet paper 10 by attaching to a paper holder, and drawing the toilet paper 20.

Although a size of the rolled toilet paper 10 is not specifically limited, one with a diameter of 90 to 120 mm, a width of 100 to 120 mm, a diameter of the paper tube of 35 to 50 mm is general, and is preferable in this example as well.

A base paper constituting the toilet paper 20 may be manufactured from a papering material for a thin paper whose main constituent is a raw material pulp. The raw material pulp is not specifically limited, and a raw material pulp may be appropriately selected in accordance with a specific purpose for the toilet paper 20, and raw material pulps may be used by blending.

Ply number and basis weight of the toilet paper 20 may be appropriately adjusted based on its purpose, and it is preferable to use a product whose ply number is one to three, whose paper thickness in total is 90 to 270 μm and whose basis weight per ply is within a range of 10 to 30 g/m$^2$. When the basis weight is greater than or equal to 10 g/m$^2$, sufficient strength for enduring in use can be obtained. When the basis weight is less than or equal to 30 g/m$^2$, the entirety of the paper does not become stiff, and becomes smooth without stiffness. Here, as a method of measuring basis weight, for example, a method based on JIS P8124:2011 or the like may be exemplified.

(Paper Tube)

Figure 2:
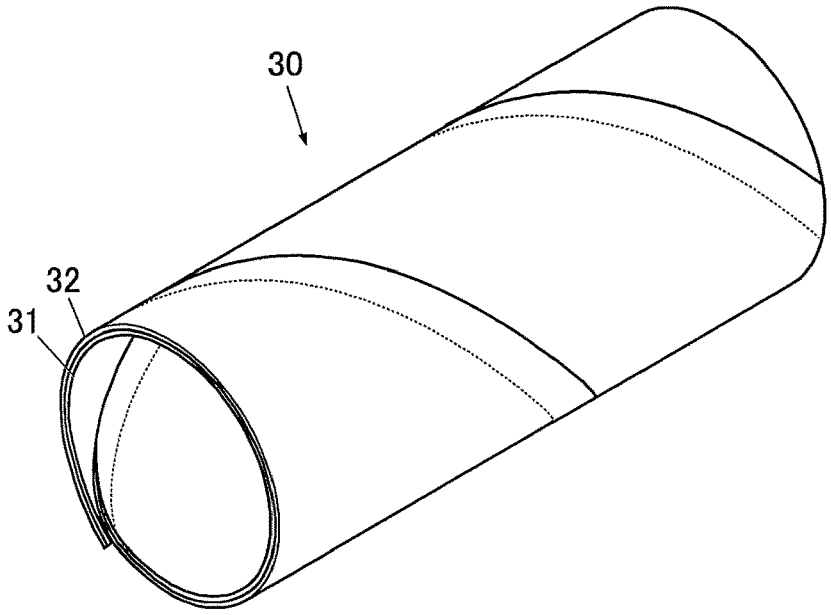
FIG. 2 is a perspective view illustrating a paper tube of the embodiment.

As illustrated in FIG. 2, for example, the paper tube 30 is formed by two base paper layers, an inside base paper layer 31 at an inside peripheral surface of the paper tube 30 and an outside base paper layer 32 at an outside peripheral surface of the paper tube 30.

Each of the inside base paper layer 31 and the outside base paper layer 32 is formed as, for example, a spiral paper tube in which the paper tube base paper is helically wound, or a planospiral paper tube. It is preferable to use a base paper whose basis weight is 130 to 200 g/m$^2$ and rigidity is 300 to 600 for the paper tube base paper constituting each of the inside base paper layer 31 and the outside base paper layer 32 from a viewpoint of maintaining strength. As a method of measuring rigidity, for example, a method based on JIS P8143:2009 or the like may be exemplified.

The inside base paper layer 31 and the outside base paper layer 32 are adhered with each other by using an adhesive agent or the like, if necessary.

When fixing the inside base paper layer 31 and the outside base paper layer 32 by using an adhesive agent, a method of adhering may be appropriately selected, and the inside base paper layer 31 and the outside base paper layer 32 may be adhered by using a hot-melt, a latex or the like in addition to a known paper tube glue (CMC, vinyl acetate or polyvinyl alcohol, for example).

Polyphenol and glycerin are impregnated in at least one of the inside base paper layer 31 and the outside base paper layer 32 of the paper tube 30 of the embodiment.

The polyphenol is a deodorant used to provide a deodorizing capability to the paper tube 30. As the polyphenol as the deodorant, tannin, catechin or the like extracted from a plant may be used.

An amount of impregnation of the polyphenol in the base paper layer may be greater than or equal to 0.01 g/m$^2$. When the amount of impregnation of the polyphenol is the above value, an appropriate deodorizing capability can be provided to the paper tube 30.

Further, the amount of impregnation of the polyphenol in the base paper layer may be less than or equal to 0.1 g/m$^2$.

Even if the amount of impregnation of the polyphenol in the base paper layer is increased to be greater than 0.1 g/m$^2$, the deodorizing capability is not drastically improved. Thus, according to the embodiment, taking cost or the like into consideration, an upper limit value of the amount of impregnation of the polyphenol may be 0.1 g/m$^2$.

The glycerin is a stabilizer (antioxidant) of the polyphenol, and is used for retaining the deodorizing capability of the polyphenol impregnated in the paper tube 30.

An amount of impregnation of the glycerin in the base paper layer may be less than or equal to 1.0 g/m$^2$. As the glycerin, which is polyol (polyalcohol), has a property to block bonding of celluloses, when the amount of impregnation in the base paper layer becomes large, there is a problem that the strength of the paper tube 30 is lowered. Thus, as a result of hard researches by the present inventors, it was found that, for example, a strength necessary for the paper tube 30 of the rolled toilet paper 10 can be obtained by setting the amount of impregnation of the glycerin to be less than or equal to 1.0 g/m$^2$, when basis weight of the paper tube base paper (base paper layer) is 130 to 200 g/m$^2$.

Meanwhile, the amount of impregnation of the glycerin in the base paper layer may be greater than or equal to 0.3 g/m$^2$. The present inventors have found that the polyphenol impregnated in the paper tube 30 can be stabilized by setting the amount of impregnation of the glycerin to be greater than or equal to 0.3 g/m$^2$.

In other words, as an anti-oxidizing effect of the polyphenol can be obtained when the amount of impregnation of the glycerin in the base paper layer is greater than or equal to 0.3 g/m$^2$, and strength of the paper tube 30 is not lowered when the amount of impregnation of the glycerin in the base paper layer is less than or equal to 1.0 g/m$^2$, it is preferable to use the glycerin within such a range.

Further, propanediol may be further impregnated in the base paper layer, among the inside base paper layer 31 and the outside base paper layer 32, to which the polyphenol and the glycerin are impregnated. The propanediol is used for, similarly as the glycerin, a stabilizer (antioxidant) of the polyphenol.

An amount of impregnation of the propanediol in the base paper layer may be less than or equal to 1.0 g/m$^2$. The propanediol, which is polyol (polyalcohol), has a property to block bonding of celluloses, similarly as the glycerin.

The present inventors have found that the strength necessary for the paper tube 30 of the rolled toilet paper 10 can be retained by setting the amount of impregnation of the propanediol to be less than or equal to 1.0 g/m$^2$, when basis weight of the paper tube base paper (base paper layer) is 130 to 200 g/m$^2$ and both of the glycerin and the propanediol are used, for example.

However, an upper limit of the amount of impregnation of the propanediol may be appropriately set in accordance with the content of the glycerin, and for example, the total content of the glycerin and the propanediol in the base paper layer may be less than or equal to 2.0 g/m$^2$.

Although a lower limit of the amount of impregnation of the propanediol in the base paper layer is not specifically limited, for example, by setting to be greater than or equal to 0.1 g/m$^2$, an effect of adding the propanediol can be obtained.

Next, results of manufacturing example samples, a comparative example sample, and reference example samples of the paper tube of the embodiment, and evaluating their capabilities are illustrated in Table 1.

In this embodiment, a paper tube base paper to become the inside base paper layer 31 was manufactured by coating a coating liquid including polyphenol and glycerin (or propanediol) to a base paper whose basis weight was 160 g/m$^2$ by gravure printing. Further, a base paper whose basis weight was 160 g/m$^2$ without coating a coating liquid was used as a paper tube base paper to become the outside base paper layer 32. The polyphenol used here was catechin 60G manufactured by Shiraimatsu Pharmaceutical CO., LTD.

Here, concentrations of the polyphenol and the glycerin (or propanediol) in each of the coating liquids were adjusted such that the amount of impregnation of each of the polyphenol and the glycerin (or propanediol) in each of the inside base paper layers 31 became a value illustrated in the following Table 1. A solvent of the coating liquid was water, and 5% of isopropyl alcohol was included in any of the coating liquids. The isopropyl alcohol was added in order to increase impregnating ability to a paper.

Then, the paper tube base paper for the inside base paper layer 31 that was dried after coating the coating liquid, and the paper tube base paper for the outside base paper layer 32 were adhered by an adhesive agent whose main constituent was polyvinyl alcohol. Then, a paper tube whose inside diameter was 41 mm was formed by helically winding while keeping the paper tube base paper for the inside base paper layer 31 positioned inside, and the paper tube was cut to be 114 mm to manufacture the paper tube 30.

(Paper Tube Strength)

Figure 3:
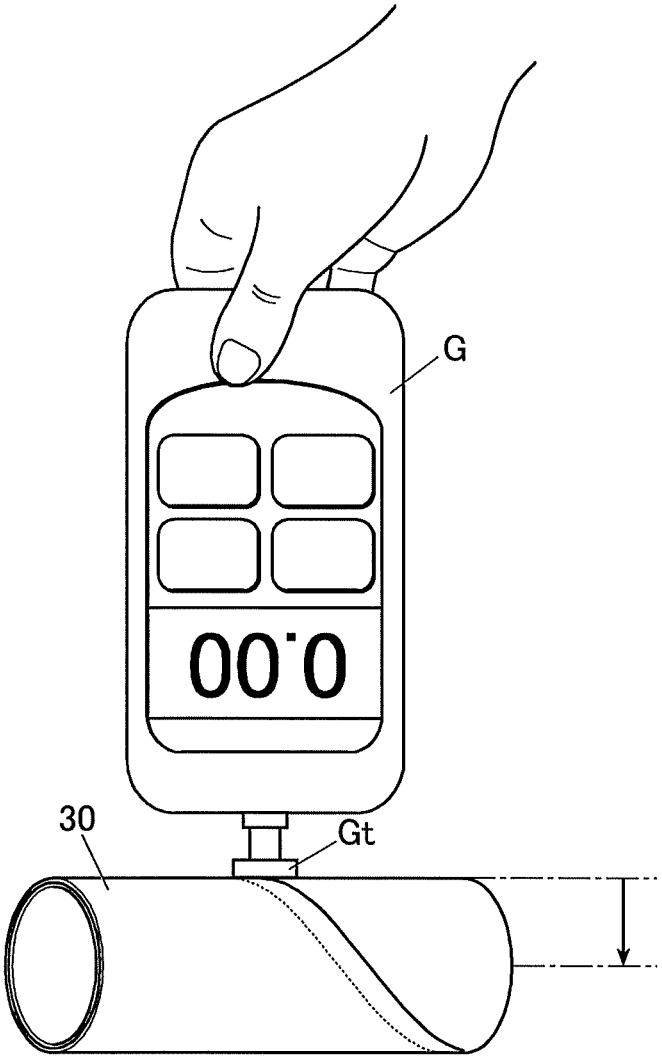
FIG. 3 is a view for describing a measurement of strength of the paper tube.

As illustrated in FIG. 3, the paper tube 30 was laterally mounted on a horizontal test board, and the paper tube 30 was set such that a helically overlapped adhered portion is positioned at an upper surface of a center of the paper tube 30 in a longitudinal direction.

After performing a zero point adjustment by matching a front edge portion Gt of a push pull gauge G at the adhered portion of the paper tube 30 positioned at the upper surface of the center of the paper tube 30, the push pull gauge G was pressed down in a lower vertical direction toward the paper tube 30. Force applied when the push pull gauge G was pressed down for 20.5 mm, which was a half of the diameter of the paper tube, was read as paper tube strength.

Evaluated results are illustrated in Table 1.

(Deodorizing Effect)

Ammonia that simulates uraroma was generated at concentration of 150 ppm in a closed vessel whose volume was 10 L, and 30 minutes after a single paper tube 30 was input in the vessel, concentration of ammonia was measured by a detector tube method. A detector (GV-100S) manufactured by GASTEC CORPORATION and a detector tube method (3 L and 3La) were used for detecting concentration of ammonia.

Further, a similar deodorizing effect test was performed on a sample after deterioration which was prepared by leaving the paper tube 30 in a thermostatic chamber set to be an environment of 50° C. RH 90% for four days.

Evaluated results are illustrated in Table 1.

TABLE 1

| | TOTAL AMOUNT OF COATING LIQUID ($g/m^2$) | POLYPHENOL ($g/m^2$) | GLYCERIN ($g/m^2$) | PROPANEDIOL ($g/m^2$) | PAPER TUBE STRENGTH (kgf) | BEFORE DETERIO-RATION | AFTER DETERIO-RATION |
|---|---|---|---|---|---|---|---|
| EXAMPLE 1 | 8 | 0.01 | 0.3 | 0.0 | 2.3 | 9 | 13 |
| EXAMPLE 2 | 8 | 0.01 | 0.8 | 0.0 | 2.2 | 8 | 11 |
| EXAMPLE 3 | 8 | 0.01 | 1.0 | 0.0 | 2.0 | 8 | 9 |
| EXAMPLE 4 | 8 | 0.05 | 0.3 | 0.0 | 2.2 | 4 | 11 |
| EXAMPLE 5 | 8 | 0.05 | 0.8 | 0.0 | 2.1 | 5 | 9 |
| EXAMPLE 6 | 8 | 0.05 | 1.0 | 0.0 | 2.0 | 3 | 3 |
| EXAMPLE 7 | 8 | 0.1 | 0.3 | 0.0 | 2.2 | 3 | 6 |
| EXAMPLE 8 | 8 | 0.1 | 0.8 | 0.0 | 2.2 | 2 | 4 |
| EXAMPLE 9 | 8 | 0.1 | 1.0 | 0.0 | 2.1 | 1 | 2 |
| EXAMPLE 10 | 8 | 0.05 | 0.8 | 0.1 | 2.0 | 3 | 4 |
| EXAMPLE 11 | 8 | 0.05 | 0.8 | 0.3 | 2.0 | 2 | 3 |
| EXAMPLE 12 | 8 | 0.05 | 0.8 | 0.8 | 2.0 | 4 | 4 |
| EXAMPLE 13 | 8 | 0.005 | 1.0 | 0.0 | 2.2 | 17 | 18 |
| EXAMPLE 14 | 8 | 0.05 | 0.1 | 0.0 | 2.4 | 2 | 21 |
| COMPARATIVE EXAMPLE | 8 | 0.05 | 0.0 | 0.0 | 2.4 | 4 | 24 |

As is apparent from the results illustrated in Table 1, by adding the glycerin in the inside base paper layer 31 in addition to the polyphenol, a deodorizing effect was improved. For example, the deodorizing effect was improved in each of the examples 4 to 6, 10 to 12 and 14 whose amount of impregnation of the polyphenol was 0.05 $g/m^2$, which was the same as that of a comparative example in which the glycerin was not included.

However, for the example 14, in which the content of the glycerin was 0.1 $g/m^2$, a deodorizing effect after deterioration was 21 ppm, and although it was improved compared with the comparative example, the deodorizing effect was low compared with other examples. Here, it is preferable that, for the deodorizing effect, the detected concentration of ammonia is less than or equal to 10% of initial concentration, in other words, less than or equal to 15 ppm. From this viewpoint, it is more preferable that the content of the glycerin is greater than or equal to 0.3 $g/m^2$.

Further, for the example 13, in which the content of the polyphenol was 0.005 $g/m^2$, a deodorizing effect after deterioration (18 ppm) was almost the same as before deterioration (17 ppm), and it can be considered that the deodorizing capability of the polyphenol can be retained compared with the comparative example. Thus, it can be considered that oxidation and deterioration of the polyphenol can be suppressed by an effect of the glycerin. However, as described above, it is preferable that the concentration of ammonia is less than or equal to 15 ppm. Meanwhile, for each of the examples 1 to 3 in which the content of the polyphenol was 0.01 $g/m^2$, the concentration of ammonia was less than or equal to 15 ppm for each of before deterioration and after deterioration. Thus, in order to make the concentration of ammonia to be approximately less than or equal to 15 ppm, it is more preferable that the content of the polyphenol is greater than or equal to 0.01 $g/m^2$.

As described above, it can be understood that the paper tube 30 has a more preferable deodorizing capability when the amount of impregnation of the polyphenol in the inside base paper layer 31 is greater than or equal to 0.01 $g/m^2$ and the amount of impregnation of the glycerin in the inside base paper layer 31 is greater than or equal to 0.3 $g/m^2$ (examples 1 to 9).

Further, by adding the propanediol in addition to the glycerin, the deodorizing effect can be improved. For example, when the content of the polyphenol was 0.05 $g/m^2$ and the content of the glycerin was 0.8 $g/m^2$, it can be understood that the deodorizing effect was improved for each of the examples 10 to 11 in which the propanediol was added compared with the example 5 in which propanediol was not included.

Next, paper tube strength was studied. Evaluation results are illustrated in Table 2.

TABLE 2

| | TOTAL AMOUNT OF COATING LIQUID ($g/m^2$) | POLYPHENOL ($g/m^2$) | GLYCERIN ($g/m^2$) | PROPANEDIOL ($g/m^2$) | PAPER TUBE STRENGTH (kgf) |
|---|---|---|---|---|---|
| REFERENCE EXAMPLE 1 | 8 | 0.05 | 1.3 | 0.0 | 1.9 |
| REFERENCE EXAMPLE 2 | 8 | 0.05 | 1.8 | 0.0 | 1.7 |
| REFERENCE EXAMPLE 3 | 8 | 0.05 | 0.8 | 1.3 | 1.8 |

Strength may not be sufficient when the paper tube strength is less than 2.0 [kgf]. When the paper tube strength is less than 2.0 [kgf], there is a risk that the paper tube may be deformed when being cut by a "log saw" in manufacturing steps of the rolled toilet paper 10. Thus, from this viewpoint, it is preferable that the paper tube strength is greater than or equal to 2.0 [kgf].

The amount of impregnation of the glycerin exceeded 1.0 $g/m^2$ and paper tube strength was less than 2.0 [kgf] for each of the reference examples 1 and 2 in Table 2. Thus, from a viewpoint of the paper tube strength, it is preferable that the amount of impregnation of the glycerin is less than or equal to 1.0 $g/m^2$.

Further, when the propanediol is used in addition to the glycerin, in the reference example 3, the amount of impregnation of the propanediol exceeded 1.0 $g/m^2$, and paper tube strength was less than 2.0 [kgf]. Thus, from a viewpoint of the paper tube strength, it is preferable that the amount of impregnation of the propanediol is less than or equal to 1.0 $g/m^2$. However, an upper limit of the amount of impregnation of the propanediol may be appropriately set in accordance with the content of the glycerin, and for example, the total content of the glycerin and the propanediol in the base paper layer may be less than or equal to 2.0 $g/m^2$.

As described above, according to the paper tube 30 of the embodiment, a deodorizing effect to an ammonia smell can be retained for a long period.

This means that according to the rolled toilet paper 10 using the paper tube 30 of the embodiment, by using it while attaching to a paper holder in a toilet, a toilet room can be deodorized and a bad smell may be moderated.

Here, although an example in which the polyphenol and the glycerin (or propanediol) are impregnated in the inside base paper layer 31 of the paper tube 30 constituted by the inside base paper layer 31 and the outside base paper layer 32 is exemplified in the above embodiment, the present invention is not limited so. The polyphenol and the glycerin (or propanediol) may be impregnated in the outside base paper layer 32, and further, the polyphenol and the glycerin (or propanediol) may be impregnated in both of the inside base paper layer 31 and the outside base paper layer 32.

Further, although the glycerin and the propanediol are exemplified as an example of the stabilizer of the polyphenol in the above embodiment, fatty acid such as other polyols may be used as the stabilizer of the polyphenol.

Further, in addition, it should be understood that specific detailed structures may be appropriately modified.

Although preferred embodiments of the present invention have been specifically illustrated and described, it is to be understood that minor modifications may be made therein without departing from the spirit and scope of the invention as defined by the claims.

The present application is based on and claims the benefit of priority of Japanese Priority Application No. 2015-180376 filed on Sep. 14, 2015, the entire contents of which are hereby incorporated by reference.

What is claimed is:

1. A paper tube that functions as a core of a rolled sheet, the paper tube comprising:

an inside base paper layer at an inside peripheral surface of the paper tube, and an outside base paper layer at an outside peripheral surface of the paper tube, polyphenol, glycerin and propanediol being impregnated in the outside base paper layer, wherein an amount of impregnation of the polyphenol is greater than or equal to 0.01 $g/m^2$ and/or is less than or equal to 0.05 $g/m^2$, wherein the paper tube has a paper tube strength that is maintained by the glycerin as antioxidant whose amount of impregnation is greater than or equal to 0.3 $g/m^2$ and less than or equal to 1.0 $g/m^2$, and wherein the paper tube has the paper tube strength that is maintained by the propanediol that is impregnated as the antioxidant so that a total content of the glycerin and the propanediol is less than or equal to 2.0 $g/m^2$.

2. The paper tube according to claim 1, wherein an amount of impregnation of the propanediol is less than or equal to 1.0 $g/m^2$.

3. A rolled sheet comprising:

the paper tube according to claim 1; and a sheet wound around the paper tube as a core.

4. The paper tube according to claim 1, wherein a coating liquid including the polyphenol and glycerin is impregnated in the at least one of the inside base paper layer and the outside base paper layer.

5. The paper tube according to claim 1, wherein the amount of impregnation of the polyphenol is less than or equal to 0.05 $g/m^2$.

6. The paper tube according to claim 1, wherein the amount of impregnation of the propanediol is greater than or equal to 0.1 $g/m^2$.

7. The paper tube according to claim 1, wherein the amount of impregnation of the polyphenol is 0.01 $g/m^2$.

8. The paper tube according to claim 1, wherein the amount of impregnation of the polyphenol is 0.05 $g/m^2$.

9. The paper tube according to claim 1, wherein the inside base paper layer is exposed to the atmosphere and the outside base paper layer is exposed to the rolled sheet.

* * * * *